US009145616B2

(12) United States Patent
Foyet et al.

(10) Patent No.: US 9,145,616 B2
(45) **Date of Patent: *Sep. 29, 2015**

(54) METHOD OF PREVENTING SILVER TARNISHING

(71) Applicant: Rohm and Haas Electroni Materials LLC, Marlborough, MA (US)

(72) Inventors: Adolphe Foyet, Lucerne (CH); Wan Zhang-Beglinger, Adligenswil (CH); Michael P. Toben, Smithtown, NY (US); Jonas Guebey, Adligenswil (CH)

(73) Assignee: Rohm and Haas Elcetronic Materials LLC

( * ) Notice: Subject to any disclaimer, the term of this patent is extended or adjusted under 35 U.S.C. 154(b) by 91 days.

This patent is subject to a terminal disclaimer.

(21) Appl. No.: 13/775,167

(22) Filed: Feb. 23, 2013

(65) Prior Publication Data

US 2013/0224515 A1 Aug. 29, 2013

Related U.S. Application Data

(60) Provisional application No. 61/604,965, filed on Feb. 29, 2012.

(51) Int. Cl.

| | |
|---|---|
| ***C25D 3/00*** | (2006.01) |
| ***C25D 3/54*** | (2006.01) |
| ***C25D 7/00*** | (2006.01) |
| ***C25D 5/10*** | (2006.01) |
| *C23C 18/16* | (2006.01) |

(52) U.S. Cl.

CPC .. *C25D 3/54* (2013.01); *C25D 5/10* (2013.01); *C25D 7/00* (2013.01); *C25D 7/005* (2013.01); *C23C 18/1653* (2013.01); *Y10T 428/12896* (2015.01)

(58) Field of Classification Search

CPC ..... C25D 3/02; C25D 3/54; C25D 7/005
USPC ..... 205/261
See application file for complete search history.

(56) References Cited

U.S. PATENT DOCUMENTS

| | | | | |
|---|---|---|---|---|
| 1,849,293 | A * | 3/1932 | Gray | 205/261 |
| 1,934,730 | A | 11/1933 | Murray et al. | |
| 2,417,967 | A * | 3/1947 | Booe | 205/261 |
| 3,641,300 | A | 2/1972 | Nitz | |
| 4,617,096 | A | 10/1986 | Kuhn et al. | |
| 2011/0012497 | A1 | 1/2011 | Sumiya et al. | |
| 2011/0151276 | A1 | 6/2011 | Wiklund et al. | |
| 2013/0270117 | A1* | 10/2013 | Szocs et al. | 205/50 |

FOREIGN PATENT DOCUMENTS

| | | | | |
|---|---|---|---|---|
| EP | 1288162 | A2 | 3/2003 | |
| EP | 2031098 | A2 * | 3/2009 | C25D 3/56 |
| JP | 2004084036 | A * | 3/2004 | C23C 28/00 |

OTHER PUBLICATIONS

European Search Report of Corresponding European Application No. 13 15 6522, Mar. 26, 2013.

* cited by examiner

*Primary Examiner* — Edna Wong

(57) ABSTRACT

A thin indium metal layer is electroplated onto silver to prevent silver tarnishing. The indium and silver composite has high electrical conductivity.

8 Claims, No Drawings

METHOD OF PREVENTING SILVER TARNISHING

This application claims the benefit of priority under 35 U.S.C. §119(e) to U.S. Provisional Application No. 61/604,965, filed Feb. 29, 2012, the entire contents of which application are incorporated herein by reference.

FIELD OF THE INVENTION

The present invention is directed to a method of preventing silver tarnishing by electroplating indium metal on silver. More specifically, the present invention is directed to a method of preventing silver tarnishing by electroplating indium metal on the silver and to provide a high conductivity indium and silver composite layer.

BACKGROUND OF THE INVENTION

Silver tarnishing takes place through a variety of mechanisms. In general, this leads to a disfiguring layer on the surface of the silver that is visually unacceptable. The main product of silver tarnishing is silver sulfide caused by the presence of sulfides, such as hydrogen sulfide, present in the atmosphere. The reaction mechanisms are $8Ag+4HS^- \leftrightarrow 4Ag_2S+2H_2+4e^-$ and $O_2+2H_2O+4e^- \leftrightarrow 4OH^-$. The first reaction is believed to occur in a thin film of water on the silver surface. In dry air, tarnishing does not take place. In the second reaction, oxygen acts as a cathodic species and consumes electrons as indicated in the equation. Higher concentrations of hydrogen sulfide increase tarnishing. Although the rate of tarnishing gradually declines with increased tarnish layer thickness, the reaction proceeds even on a heavily tarnished surface, since, owing to its coarse structure, the silver sulfide does not form a protective layer against surface corrosion. When relative humidity (rh) is between 5 and 50%, the amount of absorbed water on the surface is approximately constant and the reaction rate is steady. However, between 70 and 80% rh, surface moisture increases and accelerates the reaction rapidly.

Various attempts have been made over the years to address the problem of silver tarnishing in the jewelry and electronics industries. U.S. Pat. No. 1,934,730 discloses a method of preventing silver tarnishing by forming an alloy of 55.5% silver, 36% indium and 8.5% gold. Gold was added as one of the alloying metals because silver and indium alloys typically form an undesirable bluish tint to the alloy. However, with the price of gold as high as it is the industry is discouraged from using such an alloy. A number of conventional methods coat silver with a layer of chromium from hexavalent chromium electrolytes. However, such methods have been strictly restricted due to the hazardous and toxic nature of chromium to workers in the industry as well as to the environment. Organic anti-tarnish films, such as self-assembled monolayers of organo-thiolated molecules such as n-alkanethiol and thioaromatic molecules, have been used as a substitute in some cases but they typically lack thermal stability and the lubrication properties of the organic films further limit their uses such as where application temperature is relatively high or lubrication effect is undesired. For example, in radio frequency (RF) connector applications the lubrication effect may cause undesired vibrations between two mating parts.

U.S. 2011/0151276 discloses a method of inhibiting silver tarnishing by depositing a silver and indium alloy of 90-99 wt % silver and 1-10 wt % indium by physical or chemical vapor deposition methods. An oxide layer of $SiO_2$, $TiO_2$ or $Al_2O_3$ may be coated on the silver and indium alloy to further improve tarnish inhibition. A disadvantage of depositing metals by physical and chemical vapor deposition is that it is difficult to deposit metals on parts having irregular geometry, such as internal surfaces of tubes. In addition, depositing metals by physical or chemical vapor deposition is more costly than by plating.

TW 201103177 discloses a process for inhibiting silver tarnishing by plating an indium layer on silver followed by heating at temperatures of 150° C. to 600° C. to form a silver and indium alloy.

Although there are methods of inhibiting silver tarnishing, there is still a need for improved methods of inhibiting silver tarnishing.

SUMMARY OF THE INVENTION

A method includes providing a substrate including a silver layer; and electroplating an indium layer adjacent the silver layer to form an indium and silver composite on the substrate, the composite has a contact resistance of 5 mOhms or less.

An article includes a composite layer composed of a layer of indium 5-50 nm thick adjacent a layer of silver, the contact resistance of the composite layer is 5 mOhms or less.

The indium layer inhibits tarnishing of the silver layer and at the same time does not compromise the aesthetic aspect, ductility, wear performance or electrical properties of the silver. The method electroplates a substantially pure indium metal layer on the silver. The indium layer does not change the color or the morphology of the silver, thus the composite is desirable in the manufacture of silver containing jewelry. In addition, the indium and silver composite has low contact resistance. Accordingly, it is highly desirable for use in electronic components which typically use silver and where tarnishing compromises the electrical performance of the electrical devices, such as power connectors, light emitting diodes and RF connectors.

The method also provides a more efficient and environmentally friendly way to address the problem of silver tarnishing. The highly hazardous chromium coating methods using hexavalent chromium may be avoided. The more expensive and complex methods of coating silver with indium using physical and chemical vapor deposition processes may also be avoided. The costly vapor deposition apparatus are no longer required but instead the less costly electroplating apparatus are substituted. The method also enables an indium and silver composite which is more stable under high temperatures than conventional organic anti-tarnish films which lack thermal stability.

DETAILED DESCRIPTION OF THE INVENTION

As used throughout the specification, the following abbreviations have the following meanings, unless the context clearly indicates otherwise: ° C.=degrees Centigrade; g=gram; mg=milligram; L=liter; m=meter; A=amperes; dm=decimeter; μm=micron=micrometer; cN=centi-newtons; ppm=parts per million; ppb=parts per billion; mm=millimeter; M=molar; mOhms=milliOhms=electrical resistance; LIP=light induced plating; XRF=X-ray fluoresence; IC=integrated circuits and EO=ethylene oxide.

The terms "electroplating" and "plating" are used interchangeably throughout this specification. All amounts are percent by weight and all ratios are by weight, unless otherwise noted. All numerical ranges are inclusive and combinable in any order except where it is logical that such numerical ranges are constrained to add up to 100%.

A layer of indium metal is electroplated adjacent silver to form a composite of a distinct indium layer and a distinct silver layer and to prevent or inhibit tarnishing of the silver layer. The indium layer does not detract from the aspects of the color and morphology of the silver. The composite is uniform and substantially smooth as pure electroplated silver. Accordingly, the indium coated silver may be used to protect jewelry and other silver containing articles used for aesthetic purposes. In addition, the indium layer does not detract from the electrical properties of the silver. Silver is widely used as components in electronic devices, such as power connectors, light emitting diodes (LEDs) and RF connectors, printed circuit boards, automotive parts, aeronautical systems and other electronic devices. Efficient electrical conductivity is critical in the optimum performance of such electrical components and devices. In general, the contact resistance of the indium and silver composite layer is 5 mOhms or less, preferably the contact resistance of the indium and silver composite is 1 mOhm to 5 mOhms. The indium and silver composite retains its electrical properties under high temperatures of 150° C. and higher, typically from 150° C. to 300° C. Accordingly, articles and components containing the indium and silver composite may be used in electronic devices which may be exposed to high temperature environments.

Typically the silver is a layer or coating on a substrate, such as a metal, metal alloy, semiconductor wafer, dielectric or non-conductive material which has been made conductive by one or more conventional methods known in the art. Silver may be deposited on the substrate by conventional methods depending on the article or component. Conventional methods include, but are not limited to, electroplating, LIP or light assisted plating, electroless, immersion plating and physical or chemical vapor deposition. When the silver is deposited on the substrate, it may be deposited using conventional silver baths and formulations of which various types are well known in the art. Preferably, the silver is deposited by plating, such as electroplating, electroless plating or immersion plating. More preferably, the silver is deposited by electroplating. The specific type of silver formulation may vary depending on the type of substrate, deposition method and silver deposit thickness desired. In general, the thickness of the silver layer may range from 0.05 μm to 1 mm.

The thickness of the indium layer adjacent the silver layer ranges from 5-50 nm thick. Preferably the indium layer is 10-20 nm thick. More preferably the indium layer is 10-15 nm thick. Indium is preferably electroplated from a low indium ion concentration bath. A low indium ion concentration electroplating bath is preferred because it enables better control for electroplating the desired thickness of the indium layer onto the silver to form the composite. The indium electroplating baths include one or more sources of indium ions which are soluble in an aqueous environment.

Sources of indium ions include, but are not limited to, indium salts of alkane sulfonic acids and aromatic sulfonic acids, such as methanesulfonic acid, ethanesulfonic acid, butane sulfonic acid, benzenesulfonic acid and toluenesulfonic acid, salts of sulfamic acid, sulfate salts, chloride and bromide salts of indium, nitrate salts, hydroxide salts, indium oxides, fluoroborate salts, indium salts of carboxylic acids, such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, hydroxybutyric acid, indium salts of amino acids, such as arginine, aspartic acid, asparagine, glutamic acid, glycine, glutamine, leucine, lysine, threonine, isoleucine, and valine. Typically, the source of indium ions is one or more indium salts of sulfuric acid, alkane sulfonic acids, aromatic sulfonic acids and carboxylic acids. More typically, the source of indium ions is one or more indium salts of sulfuric acid and an alkane sulfonic acid.

The water-soluble salts of indium are included in the baths in sufficient amounts to provide an indium deposit of the desired thickness and composite surface resistivity. Although the water-soluble indium salts may be included in the baths to provide indium ions ($3^+$) in amounts of 0.5 g/L to 100 g/L, preferably the water-soluble indium salts are included in the baths to provide indium ($3^+$) ions in amounts of 0.5 g/L to 10 g/L, more preferably from 1 g/L to 6 g/L. The preferred lower indium ion concentrations enable better control over the electroplating method of plating indium on the silver to provide an indium deposit of the desired thickness and composite surface resistivity.

The indium electroplating baths also include one or more additives. Such additives are included in the indium baths to tailor the baths to help provide the desired thickness and surface morphology of the indium layer.

Buffers or conducting salts included in the indium baths may be one or more acids to provide a pH of 0 to 5, preferably from a pH of 0.5 to 3, more preferably 1 to 1.5. Such acids include, but are not limited to, alkane sulfonic acids, aryl sulfonic acids, such as methanesulfonic acid, ethanesulfonic acid, benzenesulfonic acid, toluenesulfonic acid, sulfamic acid, sulfuric acid, hydrochloric acid, hydrobromic acid, fluoroboric acid, boric acid, carboxylic acids such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, and hydroxybutyric acid, amino acids, such as arginine, aspartic acid, asparagine, glutamic acid, glycine, glutamine, leucine, lysine, threonine, isoleucine and valine. One or more corresponding salts of the acids also may be used. Typically, one or more of sulfuric acid, alkane sulfonic acids, aryl sulfonic acids and carboxylic acids are used as buffers or conducting salts. More typically, one or more of sulfuric acid, alkane sulfonic acids and aryl sulfonic acids or their corresponding salts are used.

Buffers or conducting salts are used in sufficient amounts to provide the desired pH of the compositions. Typically, the buffers or conducting salts are used in amounts of 5 g/L to 50 g/L, or such as from 10 g/L to 40 g/L, or such as from 15 g/L to 30 g/L of the baths.

Preferably one or more hydrogen suppressors are included in the indium electroplating baths to suppress hydrogen gas formation during indium metal electroplating. Hydrogen suppressors are compounds which drive the potential for water decomposition, the source of hydrogen gas, to a more cathodic potential such that indium metal may plate without the simultaneous evolution of hydrogen gas. This increases the current efficiency for indium plating at the cathode and enables formation of indium layers which are smooth and uniform in appearance. This process may be shown using cyclic voltammetry (CV) investigation well known in the art and literature. Typically, aqueous indium electroplating baths which do not include one or more hydrogen suppressors form indium deposits that are rough and uneven in appearance. Such deposits are unsuitable for use in electronic devices. Often no indium deposits are formed from such baths.

The hydrogen suppressors are epihalohydrin copolymers. Epihalohydrins include epichlorohydrin and epibromohydrin. Typically, copolymers of epichlorohydrin are used. Such copolymers are water-soluble polymerization products of epichlorohydrin or epibromohydrin and one or more organic compounds which includes nitrogen, sulfur, oxygen atoms or combinations thereof.

Nitrogen-containing organic compounds copolymerizable with epihalohydrins include, but are not limited to:

1) aliphatic chain amines;
2) unsubstituted heterocyclic nitrogen compounds having at least two reactive nitrogen sites; and,
3) substituted heterocyclic nitrogen compounds having at least two reactive nitrogen sites and having 1-2 substitution groups chosen from alkyl groups, aryl groups, nitro groups, halogens and amino groups.

Aliphatic chain amines include, but are not limited to, dimethylamine, ethylamine, methylamine, diethylamine, triethyl amine, ethylene diamine, diethylenetriamine, propylamine, butylamine, pentylamine, hexylamine, heptylamine, octylamine, 2-ethylhexylamine, isooctylamine, nonylamine, isononylamine, decylamine, undecylamine, dodecylaminetridecylamine and alkanol amines.

Unsubstituted heterocyclic nitrogen compounds having at least two reactive nitrogen sites include, but are not limited to, imidazole, imidazoline, pyrazole, 1,2,3-triazole, tetrazole, pyradazine, 1,2,4-triazole, 1,2,3-oxadiazole, 1,2,4-thiadiazole and 1,3,4-thiadiazole.

Substituted heterocyclic nitrogen compounds having at least two reactive nitrogen sites and having 1-2 substitutions groups include, but are not limited to, benzimidazole, 1-methylimidazole, 2-methylimidazole, 1,3-diemthylimidazole, 4-hydroxy-2-amino imidazole, 5-ethyl-4-hydroxyimidazole, 2-phenylimidazoline and 2-tolylimidazoline.

Typically, one or more compounds chosen from imidazole, pyrazole, imidazoline, 1,2,3-triazole, tetrazole, pyridazine, 1,2,4-triazole, 1,2,3-oxadiazole, 1,2,4-thiadiazole and 1,3,4-thiadiazole and derivatives thereof which incorporate 1 or 2 substituents chosen from methyl, ethyl, phenyl and amino groups are used to form the epihalohydrin copolymer.

Some of the epihalohydrin copolymers are commercially available such as from Raschig GmbH, Ludwigshafen Germany and from BASF, Wyandotte, Mich., USA, or may be made by methods disclosed in the literature. An example of a commercially available imidazole/epichlorohydrin copolymer is Lugalvan™ IZE, obtainable from BASF.

Epihalohydrin copolymers may be formed by reacting epihalohydrins with the nitrogen, sulfur or oxygen containing compounds described above under any suitable reaction conditions. For example, in one method, both materials are dissolved in suitable concentrations in a body of mutual solvent and reacted therein at, for example, 45 to 240 minutes. The aqueous solution chemical product of the reaction is isolated by distilling off the solvent and then is added to the body of water which serves as the electroplating solution, once the indium salt is dissolved. In another method these two materials are placed in water and heated to 60° C. with constant vigorous stirring until they dissolve in the water as they react.

A wide range of ratios of the reaction compound to epihalohydrin can be used, such as from 0.5:1 to 2:1. Typically the ratio is from 0.6:1 to 2:1, more typically the ratio is 0.7 to 1:1, most typically the ratio is 1:1.

Additionally, the reaction product may be further reacted with one or more reagents before the electroplating composition is completed by the addition of indium salt. Thus, the described product may be further reacted with a reagent which is at least one of ammonia, aliphatic amine, polyamine and polyimine. Typically, the reagent is at least one of ammonia, ethylenediamine, tetraethylene pentamine and a polyethyleneimine having a molecular weight of at least 150, although other species meeting the definitions set forth herein may be used. The reaction can take place in water with stirring.

For example, the reaction between the reaction product of epichlorohydrin and a nitrogen-containing organic compound as described above and a reagent chosen from one or more of ammonia, aliphatic amine, and arylamine or polyimine can take place and can be carried out at a temperature of, for example, 30° C. to 60° C. for, example, 45 to 240 minutes. The molar ratio between the reaction product of the nitrogen containing compound-epichlorohydrin reaction and the reagent is typically 1:0.3-1.

The epihalohydrin copolymers are included in the compositions in amounts of 5 g/L to 100 g/L. Preferably, epihalohydrin copolymers are included in amounts of 5 g/L to 50 g/L.

Other additives also may be included in the indium baths to tailor the baths to electroplating conditions and to electroplating indium onto a silver coated substrate. Such additives include, but are not limited to, one or more of surfactants, chelating agents, levelers, suppressors (carriers), and other conventional additives used in indium electroplating formulations.

Any surfactant which is compatible with the other components of the indium baths may be used. Typically, the surfactants are reduced foaming or non-foaming surfactants. Such surfactants include, but are not limited to, non-ionic surfactants such as ethoxylated polystyrenated phenol containing 12 moles of EO, ethoxylated butanol containing 5 moles of EO, ethoxylated butanol containing 16 moles of EO, ethoxylated butanol containing 8 moles of EO, ethoxylated octanol containing 12 moles of EO, ethoxylated octylphenol containing 12 moles of EO, ethoxylated/propoxylated butanol, ethoxylated beta-naphthol containing 13 moles of EO, ethoxylated beta-naphthol containing 10 moles of EO, ethoxylated bisphenol A containing 10 moles of EO, ethoxylated bisphenol A containing 13 moles of EO, sulfated ethoxylated bisphenol A containing 30 moles of EO and ethoxylated bisphenol A containing 8 moles of EO. Such surfactants are included in conventional amounts. Typically, they are included in the compositions in amounts of 0.1 g/L to 20 g/l, or such as from 0.5 g/L to 10 g/L. They are commercially available and may be prepared from methods disclosed in the literature.

Other surfactants include, but are not limited to, amphoteric surfactants such as alkyldiethylenetriamine acetic acid and quaternary ammonium compounds and amines Such surfactants are well known in the art and many are commercially available. They may be used in conventional amounts. Typically they are included in the baths in amounts of 0.1 g/L to 20 g/L, or such as from 0.5 g/L to 10 g/L. Typically, the surfactants used are quaternary ammonium compounds.

Chelating agents include, but are not limited to, carboxylic acids, such as malonic acid and tartaric acid, hydroxy carboxylic acids, such as citric acid and malic acid and salts thereof. Stronger chelating agents, such as ethylenediamine tetraacetic acid (EDTA) also may be used. The chelating agents may be used alone or combinations of the chelating agents may be used. For example, varying amounts of a relatively strong chelating agent, such as EDTA can be used in combination with varying amounts of one or more weaker chelating agents such as malonic acid, citric acid, malic acid and tartaric acid to control the amount of indium which is available for electroplating. Chelating agents may be used in conventional amounts. Typically, chelating agents are used in amounts of 0.001M to 3M.

Levelers include, but are not limited to, polyalkylene glycol ethers. Such ethers include, but are not limited to, dimethyl polyethylene glycol ether, di-tertiary butyl polyethylene glycol ether, polyethylene/polypropylene dimethyl ether (mixed or block copolymers), and octyl monomethyl polyalkylene ether (mixed or block copolymer). Such levelers are included in conventional amounts. Typically such levelers are included in amounts of 100 ppb to 500 ppb.

Suppressors include, but are not limited to, phenanthroline and its derivatives, such as 1,10-phenantroline, triethanolamine and its derivatives, such as triethanolamine lauryl sulfate, sodium lauryl sulfate and ethoxylated ammonium lauryl sulfate, polyethyleneimine and its derivatives, such as hydroxypropylpolyeneimine (HPPEI-200), and alkoxylated polymers. Such suppressors are included in the indium baths in conventional amounts. Typically, suppressors are included in amounts of 200 ppm to 2000 ppm.

Apparatus used to electroplate indium metal adjacent the silver layer of a substrate is conventional. Conventional electrodes may be used. Typically, soluble electrodes are used. More typically, soluble indium electrodes are used as anodes. The substrate to be plated with the indium metal is the cathode or working electrode. Any suitable reference electrode may be used, if required. Typically, the reference electrode is a silver chloride/silver electrode. Current densities may range from 0.05 A/dm$^2$ to 9 A/dm$^2$. Preferably the current densities range from 0.05 A/dm$^2$ to 3 A/dm$^2$.

The temperatures of the indium bath during indium metal electroplating range from room temperature to 50° C. Typically, the temperatures range from 20° C. to 40° C.

After the indium is electroplated adjacent to the silver no heat or annealing treatment is applied to the indium and silver layers to form the complete composite. Preferably heat treatment is excluded from the method. Thus the method may reduce the number of processing steps to achieve the desired indium and silver composite layer on a substrate.

The indium layer inhibits tarnishing of the silver and at the same time does not compromise the aesthetic aspect, mechanical or electrical properties of the silver. The method electroplates a substantially pure indium metal layer adjacent the silver metal layer. The indium layer does not change the color or the morphology of the silver, thus the composite is desirable in the manufacture of silver containing jewelry. In addition, the composite of a distinct indium layer and a distinct silver layer has low contact resistance. Accordingly, it is highly desirable for use in electronic components which typically use silver metal and where tarnishing compromises the electrical performance of the electrical device The method also provides a more efficient and environmentally friendly way of addressing the problem of silver tarnishing. The highly hazardous chromium coating methods using hexavalent chromium may be avoided. The more expensive and complex methods of coating silver with indium using physical and chemical vapor deposition processes may also be avoided. The costly vapor deposition apparatus are no longer required but instead the less costly metal plating apparatus are substituted. The method also enables an indium and silver composite which is more stable under high temperatures than conventional organic anti-tarnish films which lack thermal stability.

The following examples further illustrate the invention, but are not intended to limit the scope of the invention.

Example I

An accelerated tarnish test was done by immersing a portion of a clean silver coated brass coupon into an aqueous solution containing 2 wt % potassium sulfide for 10 minutes. The test coupon was then removed from the test solution and rinsed with water and dried at room temperature. The portion of the coupon which was immersed in the potassium sulfide solution turned dark brown indicating sever tarnishing.

Example 2

The following aqueous indium electroplating bath was prepared:

TABLE 2

| COMPONENT | AMOUNT |
|---|---|
| Indium ($3^+$) ions (from indium sulfate) | 3 g/L |
| Methane sulfonic acid | 30 g/L |
| Imidazole-epichlorohydrin copolymer[1] | 30 g/L |
| Water | To the desired volume |
| pH | 1 |

[1]Lugalvan ™ IZE, obtainable from BASF. (IZE contains 48-50 wt % copolymer)

A clean silver coated brass substrate was immersed in the indium electroplating bath. A soluble indium anode and the silver coated brass substrate were connected to a rectifier. The temperature of the bath was maintained at 25° C. during electroplating. The electroplating composition was continuously agitated during indium metal deposition. Throughout the electroplating period the current density was maintained at 0.5 A/dm$^2$. The indium composition remained stable, i.e. no visible turbidity, during electroplating. Indium electroplating was done for 15 seconds to plate an indium metal layer 50 nm thick on the silver. The thickness was determined by XRF analysis using a Fischercope X-ray, model XDV-SD manufactured by Helmut Fischer GmbH, Germany. The indium layer did not change the aspect of the silver in morphology and color. The surface was observed to be just as smooth as the silver layer prior to indium plating.

The indium plated coupon was then immersed into an aqueous solution containing 2 wt % potassium sulfide for 10 minutes. The test coupon was then removed from the test solution and rinsed with water and dried at room temperature. The coupon did not show any change in color indicating that the indium layer inhibited silver tarnishing.

Example 3

The contact resistance of a silver coated coupon and a silver coated coupon with a 50 nm layer of indium metal was measured by the conventional DIN EN 60512 method using a KOWI 3000 version 0.9 manufactured by WSK Mess-und datentechnik GmbH, Germany. The indium was electroplated adjacent the silver as described in Example 2 except that the indium ion concentration in the bath was 1 g/L, the copolymer concentration was 40 g/L, the methanesulfonic acid was 25 g/L and the bath temperature was 30° C. The pH of the bath was 1.2. Indium electroplating was done at a current density of 1 A/dm$^2$. In conventional tests for measuring and comparing the contact resistance of silver contact materials a force of 100 cN and greater is typically applied to the test samples. Such test forces are greater than what is typically found in many commercial articles. In this comparative test a force of 100 cN was applied to each test sample and the contact resistance was measured. There was no difference in the contact resistance between the silver coated coupon and the coupon coated with indium and silver. This indicated that the indium anti-tarnish layer did not affect the contact resistance of the silver.

Example 4

A silver coated brass coupon and indium coated silver on brass coupon were provided. The indium was electroplated on the silver by the method described in Example 1 above except that the indium ion concentration was 2 g/L, the copolymer concentration was 20 g/L, the methanesulfonic acid was at 20 g/L and the bath temperature was at 35° C. The pH of the bath was 2. Indium was electroplated at a current density of 2 A/dm$^2$. Each coupon was placed in a Memmert oven (manufactured by Memmert GmbH & Co., Germany) at 150° C. for 1 hour to test the effect of heat on the morphology of the test samples.

After 1 hour the coupons were removed from the oven and allowed to cool to room temperature. Each coupon was then tested for tarnishing in the accelerated tarnish test where each coupon was immersed into a solution of 2 wt % potassium sulfide for 10 minutes. The coupons were withdrawn and the silver coated brass coupon was dark brown in color. The indium coated silver coupon did not show any change in color indicating that the indium layer still inhibited silver tarnishing even after exposure to heat.

Example 5

The method described in Example 3 was repeated except that prior to measuring the contact resistance of each coupon the coupons were heat treated as in Example 4. After the coupons were allowed to cool to room temperature, the contact resistance for each coupon was then tested according to the DIN EN 60512 method. There was no difference in the contact resistance between the silver coated coupon and the coupon coated with indium and silver. This indicated that the indium anti-tarnish layer did not affect the contact resistance of the silver even after heat treatment.

What is claimed is:

1. A method comprising:

a) providing a substrate comprising a silver layer;

b) providing an indium electroplating bath consisting of one or more sources of indium ions, indium ions in amounts of 0.5 g/L to 6 g/L, one or more acids or salts thereof selected from the group consisting of alkane sulfonic acids, aryl sulfonic acids and sulfamic acid, one or more hydrogen suppressing epihalohydrin copolymers, the one or more hydrogen suppressing epihalohydrin copolymers are composed of an epihalohydrin and one or more nitrogen-containing organic compounds, and water, a pH of the indium electroplating bath is from 0 to 5;

c) immersing the substrate in the indium electroplating bath; and d) electroplating an indium metal layer adjacent the silver layer to form an indium and silver composite on the substrate, the composite has a contact resistance of 5 mOhms or less.

2. The method of claim 1, wherein heat is not applied to the indium and silver composite.

3. The method of claim 1, wherein the contact resistance is 1-5 mOhms.

4. The method of claim 1, wherein the indium metal layer has a thickness of 0.5-50 nm.

5. The method of claim 4, wherein the indium metal layer has a thickness of 10-20 nm.

6. The method of claim 5, wherein the indium metal layer has a thickness of 10-15 nm.

7. The method of claim 1, wherein the substrate is chosen from jewelry and an electronic component.

8. The method of claim 1, wherein the indium ions are in amounts of 0.5 g/L to 3 g/L.

* * * * *